United States Patent [19]

Shook

[11] 4,455,917

[45] Jun. 26, 1984

[54] SHOCK WAVE END CAP REMOVAL DEVICE

[75] Inventor: Richard G. Shook, Sky Forest, Calif.

[73] Assignee: General Dynamics, Pomona Division, Pomona, Calif.

[21] Appl. No.: 357,933

[22] Filed: Mar. 15, 1982

[51] Int. Cl.[3] ..... F41F 3/04

[52] U.S. Cl. ..... 89/1.817; 102/378

[58] Field of Search ..... 89/1.817, 1.8, 1.816, 89/1.818, 1 B; 102/378

[56] References Cited

U.S. PATENT DOCUMENTS

| | | | |
|---|---|---|---|
| 328,319 | 10/1885 | Moyne | 220/15 X |
| 2,609,730 | 9/1952 | Bergström | 89/1.817 |
| 3,092,286 | 6/1963 | Duff | 220/47 |
| 3,135,163 | 6/1964 | Mechlin et al. | 89/1.817 X |
| 3,135,416 | 6/1964 | Royer | 220/47 |
| 3,158,062 | 11/1964 | Feiler | 89/1.817 X |
| 3,172,330 | 3/1965 | Lidmalm et al. | 89/1.817 |
| 3,221,495 | 12/1965 | Tweet | 60/35.6 |
| 3,266,372 | 8/1966 | Mack | 89/1.5 |
| 3,313.113 | 4/1967 | Maxson | 60/254 |
| 3,384,262 | 5/1968 | Fritsch | 220/47 |
| 3,437,035 | 4/1969 | Weimholt | 102/369 |
| 3,448,653 | 6/1969 | Myers | 89/1 |
| 3,461,801 | 8/1969 | Vitale et al. | 102/357 |
| 3,499,364 | 3/1970 | D'Ooge | 89/1.817 X |
| 3,742,814 | 7/1973 | Kroh | 89/1.817 X |
| 3,752,078 | 8/1973 | Stump | 102/378 X |
| 3,962,951 | 6/1976 | Schenk | 89/1.817 X |
| 3,970,006 | 7/1976 | Copeland et al. | 89/1.817 X |
| 4,134,328 | 1/1979 | Asp et al. | 89/1.817 |
| 4,301,708 | 11/1981 | Mussey | 89/1.817 X |

FOREIGN PATENT DOCUMENTS 793927 4/1958 United Kingdom .

*Primary Examiner*—David H. Brown

*Attorney, Agent, or Firm*—Neil F. Martin; John R. Lindsay; Edward B. Johnson

[57] ABSTRACT

A missile launch cannister end cap removal device utilizing the pressure pulse of a traveling shock wave within the cannister is disclosed. A pressure chamber, the interior of which is separated from the interior of the cannister by a diaphragm having a selected rupture pressure. Gas pressure is generated in the chamber by the firing of an explosive charge at the appropriate time in the missile launch sequence. The diaphragm is ruptured by the pressure developed in the chamber introducing a traveling shock wave into the interior of the missile cannister. The pressure pulse of the shock wave removes the end caps fitted over the open ends of the cannister.

4 Claims, 5 Drawing Figures

SHOCK WAVE END CAP REMOVAL DEVICE

The Government has rights in this invention pursuant to Contract No. N00024-79-C-5202, awarded by the U.S. Navy.

BACKGROUND OF THE INVENTION

In weapon development, the use of self-propelled missiles has led to many variations in missile and launcher configurations. In the usual situation, such missiles are stored in elongated tubes or cannisters having open ends. The missiles are made ready in the cannister and fired therefrom when the missile motor is ignited. Weapon systems are in common use that employ a single cannister, or are constructed to have launcher assemblies in which several cannisters are assembled together in clusters permitting rapid multiple firings.

Characteristic of such launcher systems is the need for sealing the open ends of the missile cannister to prevent the entry of dirt, moisture, or other foreign objects, and to protect against the effects of adverse environments involving the missile carrier. Such protection is often afforded by providing removable end caps to effect the enclosure of the open-ended cannister.

In launching missiles from closed cannisters consideration must be given to removal of installed end caps. In some cases, the nature and structure of the missile is such that it may be fired through the end caps upon launching. In many instances, however, this is not a feasible solution due primarily to potential damage to missile guidance components or other weak structures located at the forward end of the missile. To overcome this limitation, and still provide protection to the interior of the cannister, it is necessary to have a method of removing one or both of the cannister end caps at the appropriate time in the missile launching sequence. In addition, end cap removal must be such as to cause the caps to be ejected clear of the missile flight path. This latter feature becomes even more important when the cannisters are assembled together to provide for multiple or sequential launching.

It is desirable therefore to provide a simple and reliable way to remove the end closure caps of missile cannisters which will avoid damage to the missile and provide an appropriate trajectory for the ejected caps. It is equally desirable to provide a means that requires minimum space and interference, particularly with the configuration of the interior of the missile cannister and complexity of the end closures. Applicant's device meets these requirements.

SUMMARY OF THE INVENTION

According to the invention a missile launch cannister end cap removal device has been devised that introduces a controlled pressure into the interior of the cannister such as to generate a travelling shock wave within the cannister for removal of cannister end caps.

In an exemplary embodiment the device comprises a chamber exterior to the missile cannister and connected to the interior of the cannister by a passage closed by a diaphragm that is rupturable at a selected pressure. An explosive charge contained within the pressure chamber is fired at an appropriate point in the missile launch sequence to generate a pressure in the chamber sufficient to rupture a diaphragm. Rupture of the diaphragm generates the shock wave within the missile cannister which travels to the ends thereof causing a pressure pulse to remove the end caps of the cannister.

It is therefore an object of the invention to provide a new and improved end cap removal device for missile launching cannisters. The device disclosed does not require special implementation, nor increase in complexity of the end cap closures, nor does it take up space within the cannister. The invention provides for positive removal and ejection of the end caps from the missile path when the weapon is launched. The device functions to remove the end caps without damage to the missile contained within the cannister.

Other objects and additional advantages of the invention will become apparent upon a reading of the following detailed description together with the drawings, in which like reference numerals refer to like parts throughout and in which.

DETAILED DESCRIPTION OF THE DRAWINGS

Figure 1:
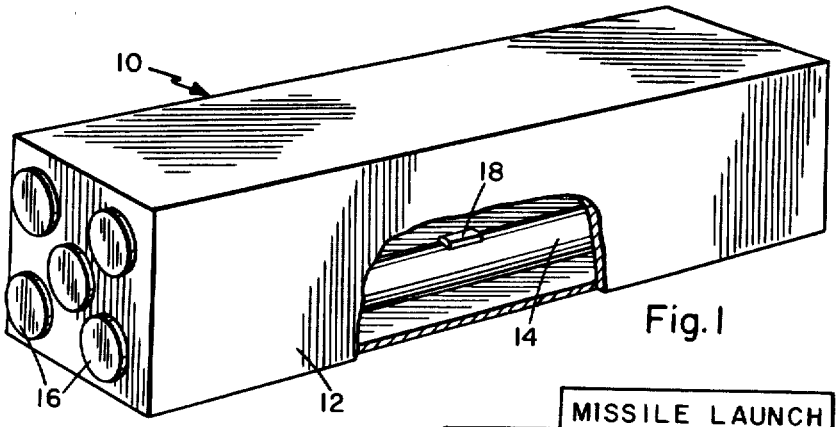
FIG. 1 is a perspective view of a typical multi-missile launcher incorporating launch cannisters with the removable end cap system.
Figure 2:
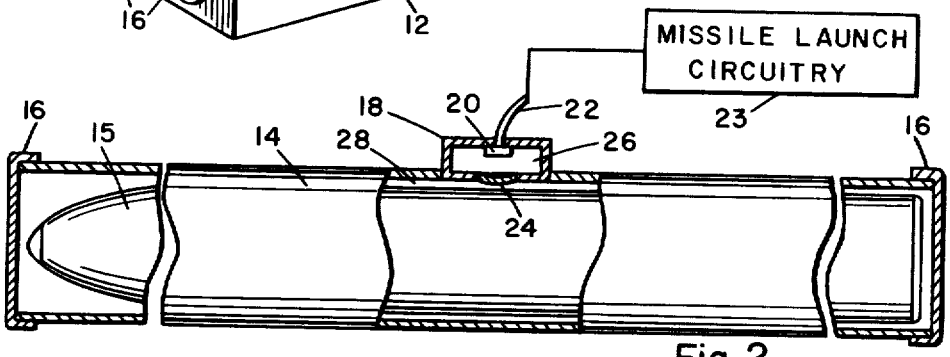
FIG. 2 is a side elevation view of a single launch cannister and missile, with portions cut away.

The missile launcher assembly 10 for storing, aiming, and launching missiles is depicted in FIG. 1. The assembly 10 consists of a housing 12 which may be mounted to a vehicle or trunnion mounted for train and elevation, the latter two arrangements not being shown. The housing is designed to receive and support one or more missile cannisters 14 which are contained within the housing 12. The cannisters 14 are elongated tubular elements with open ends into which missiles 15 are loaded as illustrated in FIG. 2. End caps 16 are fitted over the open ends of cannisters 14 to protect their interiors and the loaded missiles 15 from the entry of foreign materials and exterior environmental conditions prior to the firing of missiles 15. In the figures and the discussion which follows, the forward, or muzzle end of the cannister 14 is illustrated as being on the left side in each drawing.

In the first embodiment illustrated in FIG. 2, the cannister 14 is provided with a pressure chamber 18 positioned at the mid-point of the cannister. The pressure to generate the shock wave is developed within chamber 18. The pressure is produced by the electrical firing of an explosive charge 20 by a current pulse carried on electrical leads 22 which are connected in the missile launch circuitry 23.

Diaphragm 24 installed in the side of cannister 14 separates the interior 26 of pressure chamber 18 from the interior 28 of the cannister 14. Diaphragm 24 is designed to rupture at a preselected pressure compatible with establishing a traveling shock wave within the interior 28 of the cannister sufficient to cause the removal and ejection of the installed end caps 16 without damage to components of the cannister 14 or the loaded missile 15. Although the embodiments described reflect the use of an explosive charge 20 to generate the shock wave pressure in chamber 18, it should be recognized that an alternate means for doing so would be the employment of a pressurized gas from a container having a controlled outlet connected to the interior 26 of the chamber 18.

Figure 3:
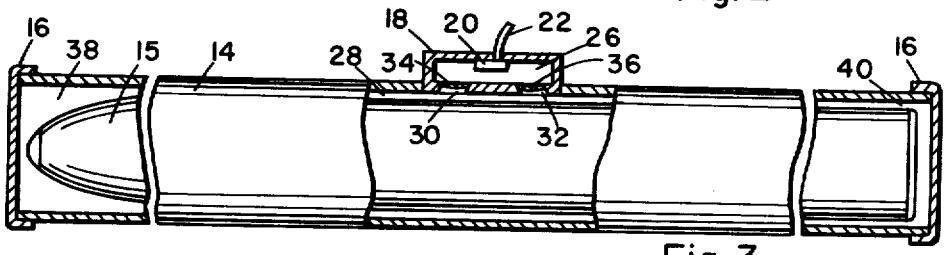
FIG. 3 is a similar side elevation view showing an alternative shock wave directing arrangement.

An alternative arrangement of the invention is illustrated in FIG. 3. In this embodiment, the interior 26 of the chamber 18 is connected to the interior of cannister 14 by a forwardly oriented passage 30 formed in the side of the cannister 14, and a similar passage 32 oriented toward the after end of the cannister 14. Diaphragms 34 and 36 located at the chamber ends of the passages 30 and 32 isolate the interior 26 of chamber 18 from the interior 28 of the cannister 14 until they are ruptured at the preselected rupture pressure by the explosive charge 20. This design provides for the initiation of two shock waves to remove and eject the end caps 16, one wave directed primarily toward the forward end 38 of the cannister 14, while the second generated shock wave is directed to the after end 40. This provides a focusing effect for the generated shock waves to provide greater impetus for the removal of the end caps 16. Variations in the size and orientation of passages 30 and 32 may be used to create different shock wave characteristics for the removal of the end caps from either the forward or the after end of cannister 14.

Figure 4:
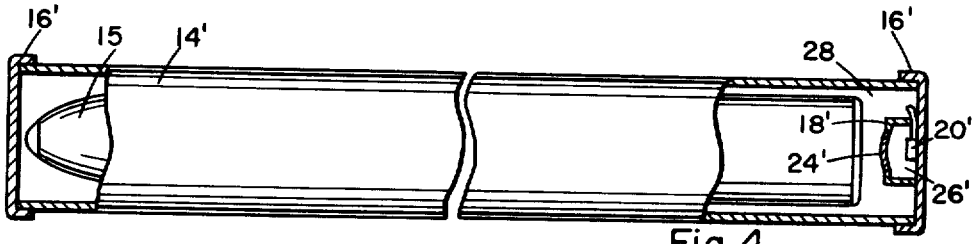
FIG. 4 is a further side elevation view showing the shock wave generator in one end cap.

A third embodiment of the invention is depicted in FIG. 4. This design permits the utilization of a generated shock wave for the removal of the end caps 16 in situations in which there is insufficient space, or there is interference, which precludes the installation of a pressure generating chamber 18 on the exterior of cannister 14. In this embodiment, the pressure generating chamber 18' is formed on the interior of one end cap 16'. The arrangement and functions of the explosive charge 20' and diaphragm 24' are the same as previously described. In this design, however, the generated traveling shock wave from one end of the cannister 14 is employed to remove and eject the end caps 16'.

OPERATION

Figure 5:
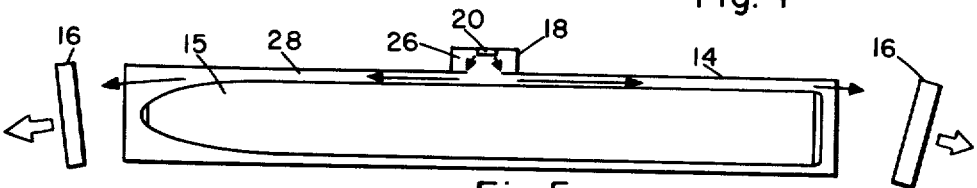
FIG. 5 illustrates diagrammatically the shock wave action removing the end caps.

The operation of the end cap removal device can be illustrated with reference to FIGS. 2 and 5. The self-propelled missile 15 is maintained within the cannister 14 as a ready round. End caps 16 close the forward and after ends of the cannister to protect its interior 28 and the missile 15 prior to missile launching. As a component of the missile launch fitting sequence, the explosive charge 20 is fired by an electrical pulse on leads 22. The pressure of the combustion products of charge 20 build up in chamber 18 to the preselected level controlled by the rupture pressure of diaphragm 24. When diaphragm 24 ruptures, the pressure within chamber 18 is suddenly released to the interior 28 of cannister 14 creating a shock wave that travels in both directions from the diaphragm position toward the ends of cannister 14 as indicated by the arrows of FIG. 5. The force of a shock wave removes and ejects the end caps 16 clearing ends of cannister 14. It has been found that a generated pressure in the chamber 18 in the order of 14 to 20 psi is sufficient to accomplish the end cap removal in one known application of the invention.

Having described my invention, I claim:

1. An end cap removal device for missile launchers comprising:

an open-ended, elongated cannister for storing and launching self-propelled missiles, removable end caps attachable to the missile cannister for covering its open ends to protect the interior thereof, means mountable on said cannister in communication with the interior thereof for generating a pressure in excess of the ambient pressure within said cannister, means for releasing the pressure of said pressure-generating means to the interior of said cannister to generate a shock wave therein, and means for actuating said pressure-generating means in the missile-firing sequence.

2. An end cap removal device for missile launchers as recited in claim 1, wherein:

said pressure-generating means and said pressure-releasing means are mountable within an end cap.

3. An end cap removal device for missile launchers as recited in claim 1, wherein said pressure-generating means comprises:

a pressure chamber, an explosive charge ignitable within said chamber.

4. An end cap removal device for missile launchers as recited in claim 3, wherein said pressure release means comprises:

a diaphragm spaced between said pressure-generating chamber and the interior of the cannister, and said diaghragm is rupturable at a preselected pressure.

* * * * *